US005163456A

United States Patent [19]

Lombardi, Jr.

[11] Patent Number: 5,163,456

[45] Date of Patent: Nov. 17, 1992

[54] COMB AND MIRROR TRAY ASSEMBLY

[75] Inventor: Carl M. Lombardi, Jr., Huntington, N.Y.

[73] Assignee: Anna Young Associates, Ltd., Freeport, N.Y.

[21] Appl. No.: 884,384

[22] Filed: May 18, 1992

[51] Int. Cl.[5] ..... A45D 24/00

[52] U.S. Cl. ..... 132/103; 132/102; 206/581

[58] Field of Search ..... 132/103, 102, 291, 301, 132/304, 316, 313, 148; 206/581

[56] References Cited

U.S. PATENT DOCUMENTS

| | | | |
|---|---|---|---|
| 421,101 | 2/1890 | Manheimer | 132/103 |
| 566,753 | 9/1896 | Glover | 132/103 |
| 1,368,735 | 2/1921 | Lang | 132/103 |
| 1,508,306 | 9/1924 | Struhson | 132/102 |
| 1,699,884 | 1/1929 | Franke | 132/103 |
| 2,041,960 | 5/1936 | Rioux | 132/316 |
| 2,420,576 | 5/1947 | Tupper | 132/103 |

*Primary Examiner*—John G. Weiss
*Attorney, Agent, or Firm*—Michael Ebert

[57] ABSTRACT

A comb and mirror-tray assembly which when in a storage mode the mirror-tray then acts to protect the comb nested therein. In a combing mode, the user who has withdrawn the comb from the mirror-tray can then view her hair in the mirror as she combs it. And in an easel mode in which the comb acts as a stand for the mirror-tray, the user may then view her face in the mirror as she applies makeup thereto. The tray, which is generally rectangular in form and has the mirror secured to its bed, is surrounded by a peripheral wall, a transverse slot being formed in the bed between the end of the mirror and the wall. In the storage mode, the comb snaps into the tray to overlie the mirror, the comb being withdrawn from the tray in the combing mode. In the easel mode, the comb is inserted in the transverse slot to serve as a stand forming an angle with the mirror-tray to support it on a table or other surface.

7 Claims, 1 Drawing Sheet

COMB AND MIRROR TRAY ASSEMBLY

BACKGROUND OF INVENTION

1. Field of Invention

This invention relates generally to hair combs and protectors therefor, and more particularly to a comb and mirror-tray assembly in which the tray acts to protect the comb, and the mirror facilitates combing operations as well as the application of makeup to the face.

2. Status of Prior Art

The typical hair comb is usually molded of synthetic plastic material and consists of a bridge extending between a pair of legs and an array of spaced teeth projecting from the bridge into the region between the legs.

The modern woman requires not only a comb for her hair but various cosmetics to make up her face. At home, these cosmetics and a comb are usually deployed on a dressing table having a large mirror so that as she sits before the mirror, the woman can see her hair as she combs it and view her face as she applies cosmetics thereto.

But when the modern woman travels to go to a party or some other affair, she will usually take along in her purse or handbag only those items she needs for the occasion, such as a comb and two or three cosmetic compacts.

One is ill advised to put an unprotected comb into a purse or handbag, for the teeth of the comb are likely to snag on other items stuffed in the purse. Nor is it a good idea to put a small glass mirror in a purse or handbag, for the mirror is likely to become dirty when brought into contact with other items in the purse. Also it is subject to breakage.

In a purse or handbag carried by a modern woman, space is at a premium, for contained therein are a wallet, keys, tissues, pills and sundry other items more or less jumbled together. Yet both a comb and a mirror must be included, for these are essential for proper grooming.

SUMMARY OF INVENTION

In view of the foregoing, the main object of this invention is to provide a travel assembly of a comb and a mirror-tray in which the removable comb normally nests in the mirror-tray and is protected thereby, the comb then shielding the mirror.

More particularly, an object of the invention is to provide an assembly of the above type in which the mirror-tray is usable not only to view the hair as it is being combined, but is also usable as a free-standing makeup mirror, the comb then acting as a stand therefor.

Yet another object of the invention is to provide an assembly of the above type which, except for the mirror, is molded of synthetic plastic material, whereby the assembly may be mass-produced at relatively low cost.

Briefly stated, these objects are attained in a comb and mirror-tray assembly which when in a storage mode the mirror-tray then acts to protect the comb nested therein. In a combing mode, the user who has withdrawn the comb from the mirror-tray can then view her hair in the mirror as she combs it. And in an easel mode in which the comb acts as a stand for the mirror-tray, the user may then view her face in the mirror as she applies makeup thereto.

The tray, which is generally rectangular in form and has the mirror secured to its bed, is surrounded by a peripheral wall, a transverse slot being formed in the bed between the end of the mirror and the wall. In the storage mode, the comb snaps into the tray to overlie the mirror, the comb being withdrawn from the tray in the combing mode. In the easel mode, the comb is inserted in the transverse slot to serve as a stand forming an angle with the mirror-tray to support it on a table or other surface.

BRIEF DESCRIPTION OF DRAWINGS

For a better understanding of the invention as well as other objects and further features thereof, reference is made to the following detailed description to be read in conjunction with the accompanying drawings, wherein.

DETAILED DESCRIPTION OF INVENTION

Figure 1:
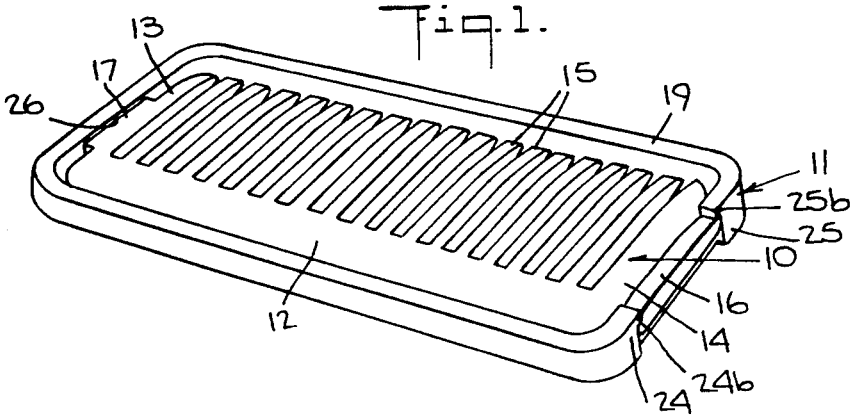
FIG. 1 is a perspective view of a travel comb and mirror-tray assembly in accordance with the invention in its storage mode.
Figure 2:
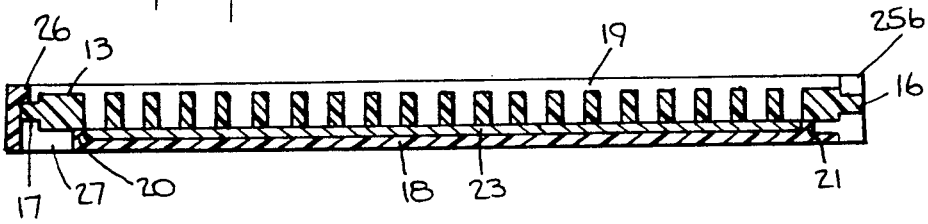
FIG. 2 is a longitudinal section taken through this assembly.

Referring now to FIGS. 1 and 2, a travel assembly in accordance with the invention consists of a comb, generally designed by reference numeral 10, and a mirror-tray, generally designated by numeral 11. In the storage mode of the assembly when it is not in use, comb 10 is then nested within the mirror-tray 11 and protected thereby.

Figure 3:
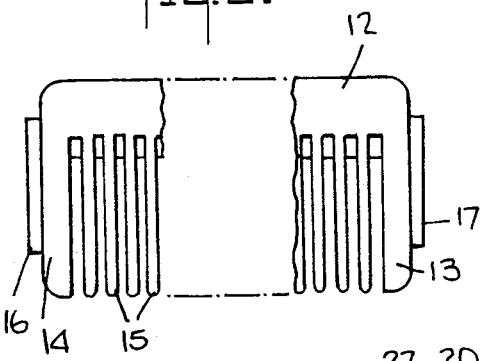
FIG. 3 is a separate view of the comb.

As shown separately in FIG. 3, comb 10, which is generally rectangular in form and has rounded corners, is constituted by a straight bridge 12 extending between a pair of legs 13 and 14, and an array of spaced teeth 15 projecting from the bridge into the region between the legs. Integral with legs 13 and 14 and projecting laterally therefrom are short left and right tongues 16 and 17 whose extremities are bevelled. The comb is molded of resilient, synthetic plastic material of high strength, such as polypropylene, polyethylene, or PVC.

Figure 4:
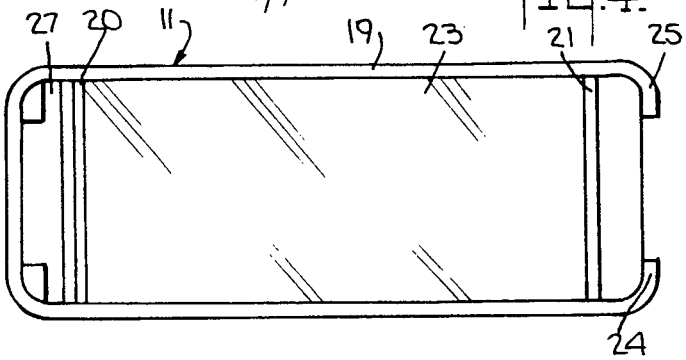
FIG. 4 is a separate view of the mirror-tray.
Figure 5:
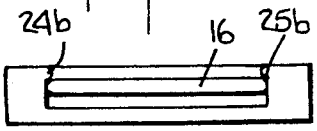
FIG. 5 is an end view of the assembly.

As shown separately in FIG. 4, mirror-tray 11, which is formed of the same material as the comb or of a similar material, has a generally rectangular form with rounded corners which conform to the rounded corners of the comb nested therein. Mirror-tray 11 includes a flat bed 18 surrounded by a peripheral wall 19 whose height is such as to create a shallow tray whose depth is just sufficient to accommodate the comb.

Integral with bed 18 and adjacent the left and right end sections of wall 19 is a pair of ridges 21 and 22 which together with the side sections of wall 19 define a frame for accommodating a rectangular mirror 23. The mirror is bonded to the flat bed by a suitable adhesive.

The left end section of wall 19 is provided with a gap bordered by vertical banks 24 and 25 to create a snap-in socket to receive the left tongue 16 of the comb whose width matches that of the gap. The upper edges of banks 24 and 25 have inwardly-projecting nibs **24*b* and 25*b* which slightly reduce the width of the gap to prevent tongue 16** from freely entering this gap.

In order, therefore, for tongue 16 to enter the snap-in socket defined by banks 24 and 25, the extremities of the tongue which engage nibs **24*b* and 25*b* must override these nibs and in doing so snap into the socket. To remove the comb from the mirror-tray, a finger is placed under tongue 16** to snap the tongue out of the socket.

The right end section of wall 19, as shown in FIG. 2, is provided at its upper edge with an inwardly-projecting ledge 26. Hence in order to nest comb 10 in the tray, the right tongue 17 of the comb must first be slid under ledge 26, after which the left tongue 16 is snapped into the socket at the left end section of wall 19.

Formed in bed 18 of the tray between ridge 21 and the right end section of wall 19 is a transverse slot 27 whose width is slightly greater than the thickness of comb 10 so that the comb may be freely inserted in this slot.

In the combing mode of the assembly, when the user wishes to comb her hair, she withdraws comb 10 from mirror-tray 11, holding the comb in one hand while viewing her hair in mirror 23 in mirror-tray 11 which she holds in her other hand.

Figure 6:
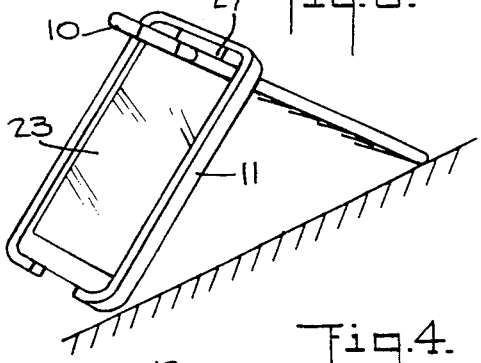
FIG. 6 shows the assembly in its easel mode in which the comb acts as a stand to support the mirror tray at a suitable viewing angle.

But when the user wishes to apply makeup to her face, she often needs both hands for this purpose; one to hold a compact containing a cosmetic, such as eye shadow, and the other a brush to apply the eye shadow. In that situation, the user requires a mirror to view her face. This mirror is provided in the easel mode of the assembly, as shown in FIG. 6, where it will be seen that comb 10 is inserted in slot 27 of mirror-tray 11 to occupy a position thereon at which the comb, serving as an easel stand, functions to support the mirror-tray at a viewing angle on a supporting table or other surface 28. Or in practice, the arrangement may be reversed, with the comb lying almost horizontally on a surface, and the mirror-tray in which the comb is inserted then being almost vertical.

Thus the assembly, which can conveniently be carried in a purse or handbag, operates selectively in three modes: the first being the storage mode, as shown in FIG. 1, in which the comb is protectively nested in the mirror-tray, the mirror then being shielded by the comb. In the combing mode, the comb is separated from the mirror-tray, as shown in FIGS. 3 and 4, so that the user, holding the mirror-tray in one hand with the comb held in the other hand can view her hair as she combs it. In the third mode, as shown in FIG. 6, the user can apply makeup to her face as she views it in the free-standing mirror.

While there has been shown and described a preferred embodiment of a comb and mirror-tray assembly in accordance with the invention, it will be appreciated that many changes and modifications may be made therein without, however, departing from the essential spirit thereof.

I claim:

1. A comb and mirror-tray assembly comprising:

(a) a generally rectangular comb provided with a bridge extending between a pair of legs and an array of teeth extending from the bridge into a region between the legs, each leg having a short tongue of predetermined width projecting laterally therefrom;

(b) a generally rectangular tray having a flat bed surrounded by a peripheral wall defined by opposing end sections and side sections, said wall having a height creating a shallow tray for nesting said comb, and a mirror secured to said bed which is shielded by said comb when it is nested in the tray, one end section of the wall having at its upper edge an inwardly-projecting ledge, the opposing end section having a gap therein bordered by vertical banks each having at its upper edge an inwardly-projecting nib, the width of the gap matching the width of said tongue to define a snap-in socket, whereby to nest the comb in the tray, one tongue thereof is inserted under the ledge and the other tongue is snapped into the socket to underlie the nibs.

2. An assembly as set forth in claim 1, in which the comb and the tray are both molded of resilient, synthetic plastic material.

3. An assembly as set forth in claim 1, in which the corners of the comb are rounded and the corners of the tray are rounded to conform to the comb.

4. An assembly as set forth in claim 1, in which the extremities of each tongue are bevelled to make it possible for the tongue, when these extremities engage the nibs, to override the nips and snap into the socket.

5. An assembly as set forth in claim 1, wherein said bed is provided with parallel ridges to define with said side sections of the wall a frame for accommodating the mirror.

6. An assembly as set forth in claim 1, wherein said bed is provided with a transverse slot adjacent one of said end sections of the wall whose width substantially matches the thickness of the comb, whereby the comb may be inserted in the slot to serve as an easel stand to support said mirror at a viewing angle.

7. A comb and mirror-tray assembly comprising:

(a) a generally rectangular comb provided with a bridge extending between a pair of legs and an array of teeth extending from the bridge into a region between the legs, each leg having a short tongue of predetermined width projecting laterally therefrom;

(b) a generally rectangular tray having a flat bed surrounded by a peripheral wall defined by opposing end sections and parallel side sections, and having a height creating a shallow tray for nesting said comb, and a mirror secured to said bed which is shielded by said comb when it is nested in the tray, said bed having a transverse slot adjacent one of said end sections of the wall whose width substantially matches the thickness of the comb, whereby the comb may be inserted in said slot to serve as an easel stand to support said mirror at a viewing angle.

* * * * *